US006997199B1

(12) United States Patent
Wright

(10) Patent No.: US 6,997,199 B1
(45) Date of Patent: Feb. 14, 2006

(54) TENT STAKE DEVICE

(76) Inventor: David O. Wright, 3000 Executive Pkwy., Suite 210, San Ramon, CA (US) 94583

( * ) Notice: Subject to any disclaimer, the term of this patent is extended or adjusted under 35 U.S.C. 154(b) by 2 days.

(21) Appl. No.: 10/409,490

(22) Filed: Apr. 9, 2003

(51) Int. Cl.
*E04H 15/62* (2006.01)

(52) U.S. Cl. ..... 135/118; 52/155

(58) Field of Classification Search ..... 135/118, 135/120.3, 120.4, 115, 116, 124; 52/4, 23, 52/155; 248/533, 153, 530, 745, 71; 5/417; 16/6

See application file for complete search history.

(56) References Cited

U.S. PATENT DOCUMENTS

| | | | | | |
|---|---|---|---|---|---|
| 132,610 | A | | 10/1872 | Wells | |
| 286,461 | A | * | 10/1883 | McOmber | 256/47 |
| 827,438 | A | * | 7/1906 | Gorrell | 135/118 |
| 1,304,779 | A | * | 5/1919 | Juelson | 135/118 |
| 1,834,084 | A | * | 12/1931 | Barnes | 47/23.2 |
| 2,817,346 | A | | 12/1957 | Whitney | |
| 3,280,829 | A | | 10/1966 | Glendenning et al. | |
| 3,598,133 | A | * | 8/1971 | Abert et al. | 135/94 |
| 3,830,457 | A | * | 8/1974 | Stewart | 248/499 |
| 4,038,997 | A | * | 8/1977 | Smith | 135/114 |
| 4,063,567 | A | | 12/1977 | Martin et al. | |
| 4,305,414 | A | * | 12/1981 | Bareis | 135/116 |
| 4,432,382 | A | | 2/1984 | Wolf | |
| 4,905,718 | A | | 3/1990 | Vandiver | |
| 5,564,232 | A | | 10/1996 | Callaway | |
| D377,076 | S | | 12/1996 | Adams | |
| 5,615,699 | A | | 4/1997 | Lee | |
| 6,256,942 | B1 | | 7/2001 | Schatz | |
| D446,838 | S | | 8/2001 | Carey | |
| 6,637,171 | B1 | * | 10/2003 | Toone | 52/677 |
| 6,772,565 | B1 | * | 8/2004 | Schiltz et al. | 52/155 |
| 2001/0039769 | A1 | | 11/2001 | Orr | |

FOREIGN PATENT DOCUMENTS

| | | |
|---|---|---|
| WO | WO 96/07805 | 3/1996 |

* cited by examiner

*Primary Examiner*—Janet M. Wilkens
(74) *Attorney, Agent, or Firm*—Theodore J. Bielen, Jr.

(57) ABSTRACT

A tent stake device used in conjunction with a tent having a tent fly and ground surface cover utilizing a ground-penetrating shaft. A first appendage is connected to the shaft and links to the tent itself. A second appendage connected to the shaft supports the edge of the ground penetrating cover above the ground surface.

8 Claims, 2 Drawing Sheets

TENT STAKE DEVICE

BACKGROUND OF THE INVENTION

The present invention relates to a novel and useful tent stake device.

Tents, which are used to provide temporary shelters as a necessity or as a recreation activity, are normally not entirely waterproof. Commonly, tents are constructed of breathable material that permit passage of air through the walls and ceilings. In addition, the floor of tents are normally constructed of a more water repellant material, although seepage does occur through the floor of a tent despite this construction. Most tents are fitted with waterproof rain flies, which are extended over the upper portion of the tent, and ground covers which underlie the floor of the tent. When rain does occur, rainwater run tends to run in between the ground cover and the tent floor, which permits seepage of water into the interior of the tent. In many cases, water also drains from the rain fly over the edge of the tarp and, again, flows between the tarp and the tent base. Hilly terrain exacerbates the water seepage dilemma described above.

In the past, many tents systems have been proposed to secure the same to the ground surface. For example, U.S. Pat. No. 132,610 and U.S. Patent Application Publication 2001/039769 show anchors or stakes which include notches in the body to allow securement of tent ropes or lines.

U.S. Pat. No. 5,564,232 shows a hold-down device or retainer having a handle and a ring along the shaft to retain a tarp in place on a ground surface.

U.S. Pat. Nos. 2,817,346, 3,280,829, 6,256,942, Des. 377,076 and D446,838 show tent anchors or stakes having notches which extend outwardly as a part of appendages connected to the body of the stake to hold ropes tethers or lines associated with a tent.

PCT Application WO 96/07805 describes a tent peg having a flange which is removably fixed to the peg to aid in the holding of tethers connected to tents.

U.S. Pat. Nos. 4,432,382 and 4,905,718 describe tent stakes having closed loops on the end portion extending above the ground surface to secure tent wires and ropes.

U.S. Pat. Nos. 4,063,567 and 5,615,699 describe tent pegs and bases which employ a combination of flanges and hooks to aid in the securement of tents to a ground surface.

A tent stake device which is able to secure a tent, and other water seepage preventing items, used in conjunction with a tent, would be a notable advance in the field of outdoor equipment.

BRIEF SUMMARY OF THE INVENTION

In accordance with the present invention a novel and useful system for securing a tent, a tent fly, and a ground surface cover is hereinafter described.

The system of the present invention utilizes a shaft having an end portion for penetrating the ground surface and supporting the shaft in an upright configuration with a portion of the shaft positioned above the ground surface. A first appendage is connected to the shaft at a first place along the shaft. The first appendage may be removably fastened and be used for linkage to the tent itself through the use of loops or lines which are normally found connected to the tent. The first appendage may include an arm extending outwardly from the shaft and a second portion connected to the arm which extends downwardly toward the ground surface.

A second appendage is also employed with the shaft of the present invention and is connected to the same in a permanent or removable manner. The second appendage lies along the shaft and positions closer to the ground surface than the first appendage. The second appendage would include a loop or hook which permits securement of the ground cover associated with the tent such that the edge of the ground cover is lifted form the ground surface to prevent the flow of water over the ground cover and between the base of the tent and the upper portion of the ground cover.

In addition, a third appendage may be employed with the system of the present invention. The third appendage may be removably or permanently fixed to the shaft and extend outwardly from the shaft in a direction opposite to that of the first appendage. The third appendage would again include a notch or a loop to allow securement of the tether extending to the rain fly, which extends over the top portion of the tent. Such securement would provide positioning of the edge of the rain fly to overlie the uplifted edge of the tarp such that water draining from the rain fly does not engage the ground cover.

It may be apparent that a novel and useful system for securing a tent and its water protection devices is herein provided.

It is therefore an object of the present invention to provide a device for securing a tent which is simple to employ and prevents the passage of water between the base of the tent and the ground cover underlying the base of the tent.

Another object of the present invention is to provide a device for securing a tent and its water protection devices which is compact and may be easily stored and transported.

A further object of the present invention is to provide a device for securing a tent and its water protection components which is formed into multiple parts and is easily assembled for use.

Yet another object of the present invention is to provide a device for securing a tent and its water protection components which is reliable and may be employed on flat or hilly terrain.

The invention possesses other objects and advantages especially as concerns particular characteristics and features thereof which will become apparent as the specification continues.

For a better understanding of the invention reference is made to the following detailed description of the preferred embodiments thereof which should be referenced to the prior described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior delineated drawings.

Figure 1:
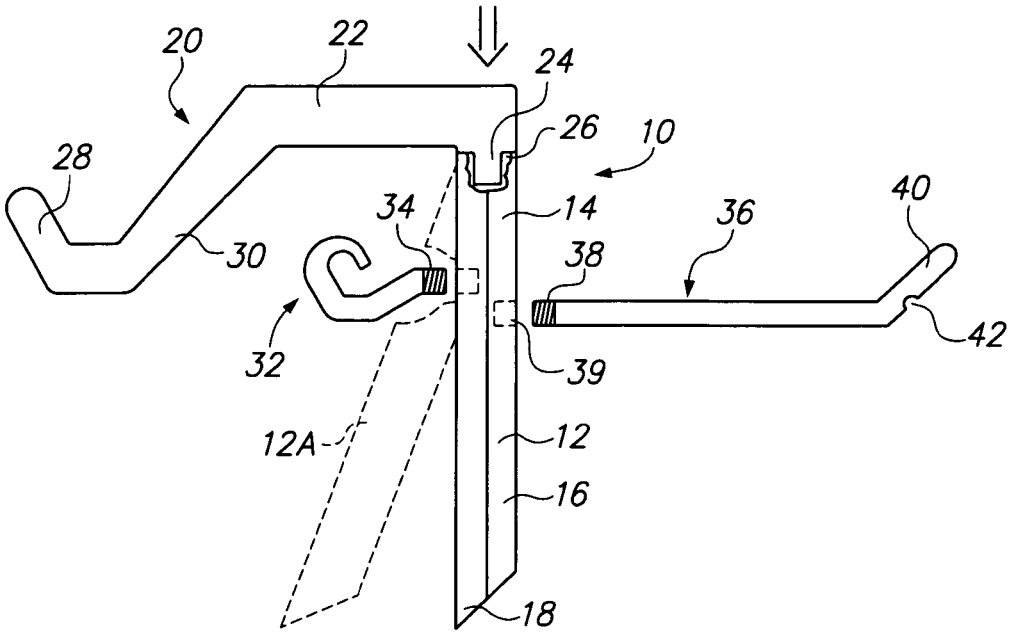
FIG. 1 is a side exploded elevational view of the system of the present invention.

The invention as a whole is shown in the drawings by reference character 10. Tent securing system 10 includes as one of its elements a shaft 12, FIGS. 1 and 3. Shaft 12 is formed with an upper portion 14 and a lower portion 16 which terminates in a tip 18 which permits the penetration of lower portion 16 into a ground surface. In this regard, when lower portion 16 of shaft 12 is driven into the ground, shaft 12 is generally in an upright position. Shaft 12A is depicted in the drawing in phantom to indicate that an alternate embodiment may be formed of such shaft in an angulated configuration.

Device 10 includes as one of its elements a first appendage 20 which extends outwardly from shaft 12. First appendage includes a first portion 22 having a boss 24 which friction fits into an opening 26 at upper portion 14 of shaft 12. Thus, boss 24 allows appendage 20 to be removably fixed to shaft 12. An end portion 28 of first appendage 20 is formed into the shape of a hook. It should be understood that end portion 28 may take other line securing configurations such as notches, open and closed loops, and the like. Intermediate portion 30 angles downwardly relative to first portion 22 of appendage 20 and interconnects end portion 28 with first portion 22. First appendage 20 is intended to secure the main body of the tent, which will be discussed hereinafter.

A second appendage 32 is formed into a hook which removably attaches to shaft 12. Second appendage 32 is depicted as having a threaded end 34, although other means may be employed to secure second appendage 32 to shaft 12 such as friction fitting, spring securement, snap-in fixation, and the like. It should be noted that hook 32 lies below first portion 22 of first appendage 20. Second appendage is intended to elevate and hold the edge of a ground cover of the tent system which will be described hereinafter.

A third appendage 36 is also employed in device 10. Third appendage 36 possesses a threaded end portion 38 for securement to threaded opening 39 of shaft 12. Again, other means of securement may be employed in this regard as hereinabove discussed with respect to second appendage 32. Third appendage 36 also possesses an angulated end 40 having a notch 42. When placed in, or connected to, shaft 12, third appendage 36 is intended to secure tethers or lines connected to a rain fly associated with the tent system, which will be discussed hereinafter.

Figure 2:
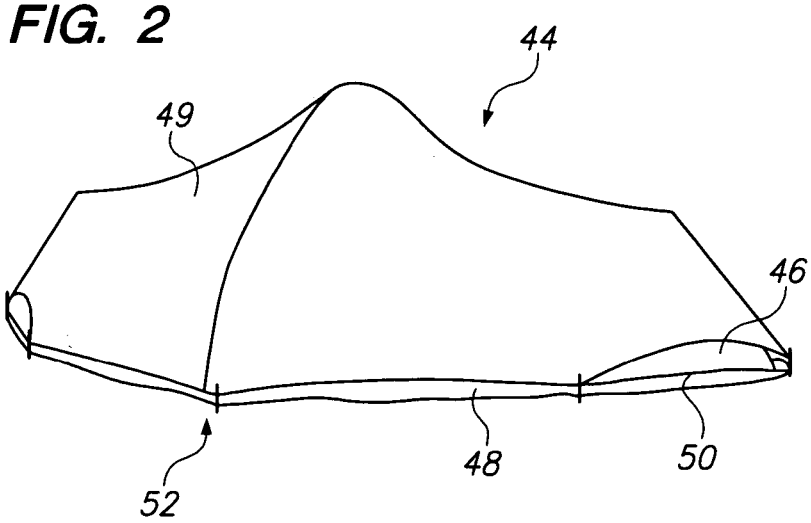
FIG. 2 is a side elevational view of a typical tent utilizing a rain fly and a ground cover in conjunction with the body of the tent.

Turning to FIG. 2, it may be observed that a tent system 44 is shown. Tent system 44 includes a main body 46 lying beneath a rain fly 49. A ground cover 48 underlies the base 50 of tent main body 46. A plurality of stakes 52 of the present invention may be employed in tent system 44 or be employed with conventional stakes. That is to say, every stake depicted in FIG. 2 need not be the tent stake device of the present invention.

Figure 3:
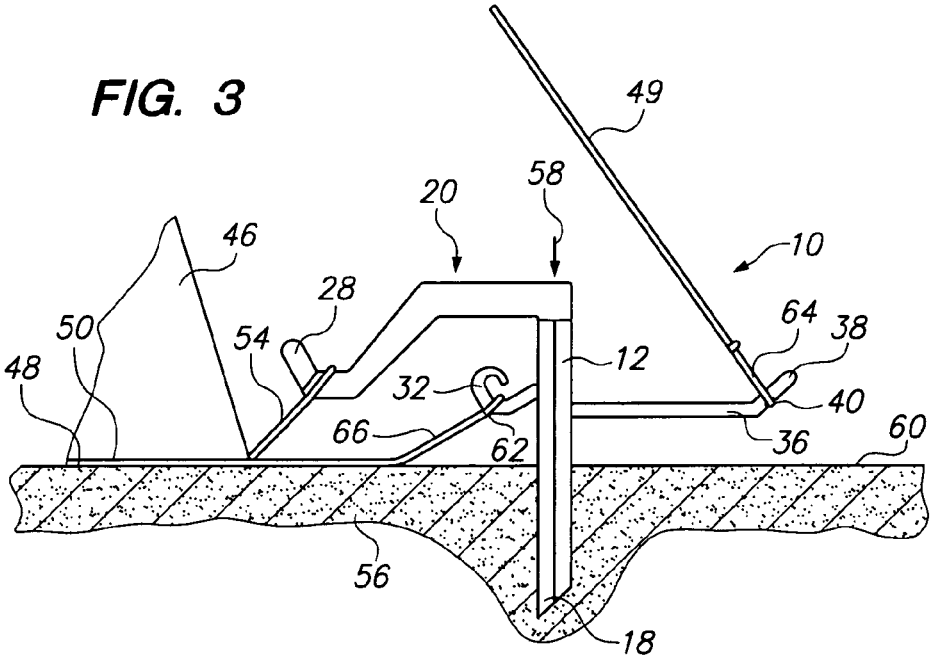
FIG. 3 is a side elevational view of the device of the present invention in operation with a tent apparatus.

Referring now to FIG. 3, it may be seen that device 10 is shown as being employed with tent main body 46, ground cover 48, and rain fly 49. That is to say, a loop 56, normally attached to tent main body 46 is placed over end portion 28 of first appendage 20. Shaft 12 has been driven into groundmass 56. Second appendage 32 and third appendage 36 have also been attached to shaft 12. Directional arrow 58 indicates the force applied to device 10 in order to penetrate ground surface 60 and permit shaft 12 to extend into groundmass 56. Ground cover 48 includes a grommet 62 which fits over second appendage 32. Rain fly 49 possesses a line 64 which loops over end 38 of second appendage 36 and fits into notch 40.

In operation, the user sets up tent body 46 over ground cover 48 in the normal manner. Rain fly 49 is then placed over tent body 48. The result is a tent system of conventional configuration which offers protection against excessive moisture from the sky or on the ground. Device 10 is employed with the tent system at each stake point depicted in FIG. 2 or at selected stake points. With reference to FIG. 3, device 10 is forced into ground mass 56, directional arrow 58, such that first appendage 20 extends toward tent body 46. Loop 54 is placed over end portion 28 of first appendage 20 to secure tent body 46. Likewise, ground cover 48 is passed over second appendage 32 by the use of grommet 62 or other securing means such as lines or loops. The edge 66 of ground cover 48 is lifted from ground surface 60 to prevent water from passing atop ground cover 48 and between ground cover 58 and base 50 of tent body 46. Thus, seepage through base 50 of tent body 46 is prevented. Rain fly 49 is extended over shaft 12 of device 10 and secured to third appendage 36 by the use of end portion 38 and notch 40, via line 64 attached to rain fly 49. Consequently, device 10 is capable of preventing water draining from rain fly 48 from passing, again, between ground cover 48 and base 50 of tent body 46.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A tent, tent fly, and ground surface cover securing system, comprising:

a. a shaft, said shaft having an end portion for penetrating the ground surface and supporting said shaft in an upright configuration;

b. a first appendage being connected to said shaft a first place along said shaft, said first appendage possessing an extension outwardly from said shaft in one direction to a certain distance, said first appendage being capable of linkage to the tent;

c. a second appendage connected to said shaft at a second place along said shaft, said second appendage lying between said first place along said shaft and said ground penetrating end portion of said shaft, said second appendage extending outwardly from said shaft generally in said one direction to a distance less than said certain distance of extension of said first appendage from said shaft, said second appendage being capable of linkage to said ground surface cover; and d. a third appendage, said third appendage connected to said shaft at a third place, said third appendage extending outwardly from said shaft in another direction relative to outwardly extension of said first appendage, said third appendage being capable of linkage to said tent fly.

2. The system of claim 1 in which said first appendage includes a hook.

3. The system of claim 2 in which said second appendage includes a hook.

4. The system of claim 3 in which said third appendage includes a notch.

5. The system of claim 1 in which said second appendage includes a hook.

6. The system of claim 1 in which said third appendage includes a notch.

7. The system of claim 6 in which said second appendage includes a hook.

8. The system of claim 1 said first and second appendages are removably fixed to said shaft.

* * * * *